United States Patent [19]

Vinals et al.

[11] 4,067,344

[45] Jan. 10, 1978

[54] NOVEL TOBACCO PRODUCT COMPRISING ONE OR MORE THIAZOLINES AND PROCESS

[75] Inventors: Joaquin F. Vinals, Red Bank, N.J.; Jacob Kiwala, Brooklyn; Donald Arthur Withycombe, Lincroft, both of N.Y.; Braja Dulal Mookherjee, Holmdel; Cynthia J. Mussinan, Bricktown, both of N.J.

[73] Assignee: International Flavors & Fragrances Inc., New York, N.Y.

[21] Appl. No.: 730,157

[22] Filed: Oct. 7, 1976

[51] Int. Cl.[2] ..... A24B 3/12

[52] U.S. Cl. ..... 131/17 R; 131/144

[58] Field of Search ..... 131/17, 144, 2; 426/533–537; 260/306.7

[56] References Cited

U.S. PATENT DOCUMENTS

| | | | |
|---|---|---|---|
| 3,778,518 | 12/1973 | Copier et al. | 260/306.7 X |
| 3,816,445 | 6/1974 | Dubs | 260/306.7 |

*Primary Examiner*—Robert W. Michell
*Assistant Examiner*—V. Millin
*Attorney, Agent, or Firm*—Arthur L. Liberman; Franklin D. Wolffe

[57] ABSTRACT

Described is a tobacco product having added thereto an amount sufficient to augment or enhance the flavor or aroma of a tobacco product particularly on smoking, of one or more thiazoline compounds having the generic structure:

wherein, X is one of:

or and wherein, one of $R_1$ or $R_2$ is methyl and the other of $R_1$ or $R_2$ is hydrogen; processes for producing such tobacco products and flavor formulations for use in conjunction with tobacco products containing one or more of such thiazoline compounds.

10 Claims, 11 Drawing Figures

FIG. 2
GC-MS PROFILE ISOMER I FOR EXAMPLE I
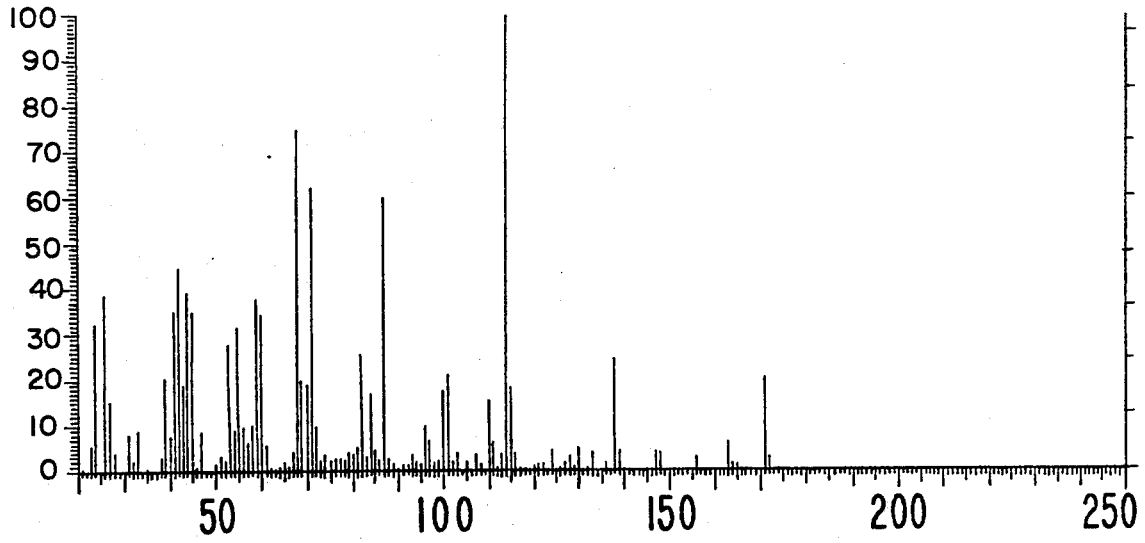
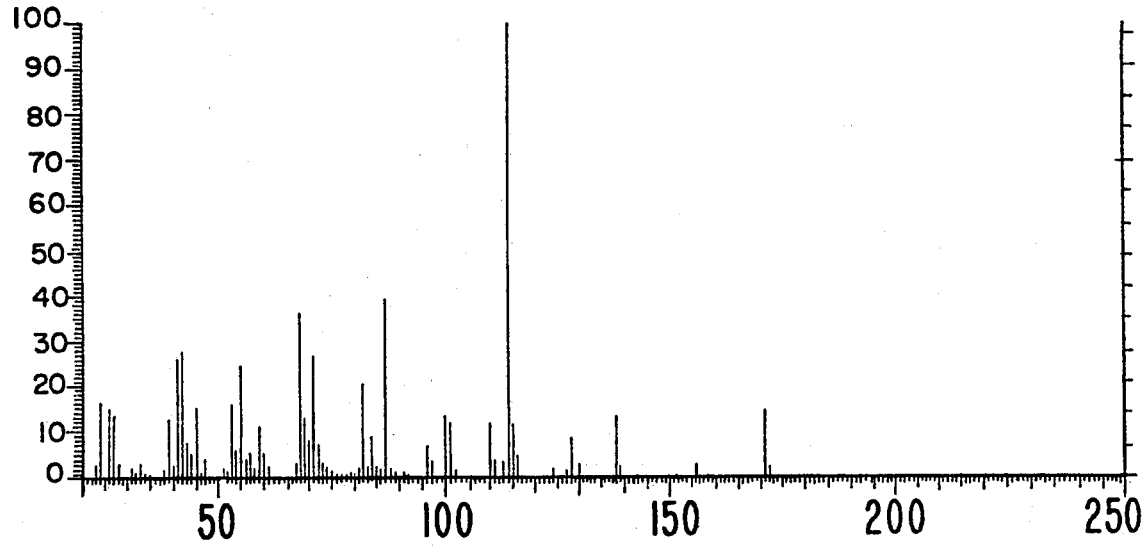
GC-MS PROFILE ISOMER II FOR EXAMPLE I
FIG. 3

FIG.4
GC-MS PROFILE ISOMER I FOR EXAMPLE II
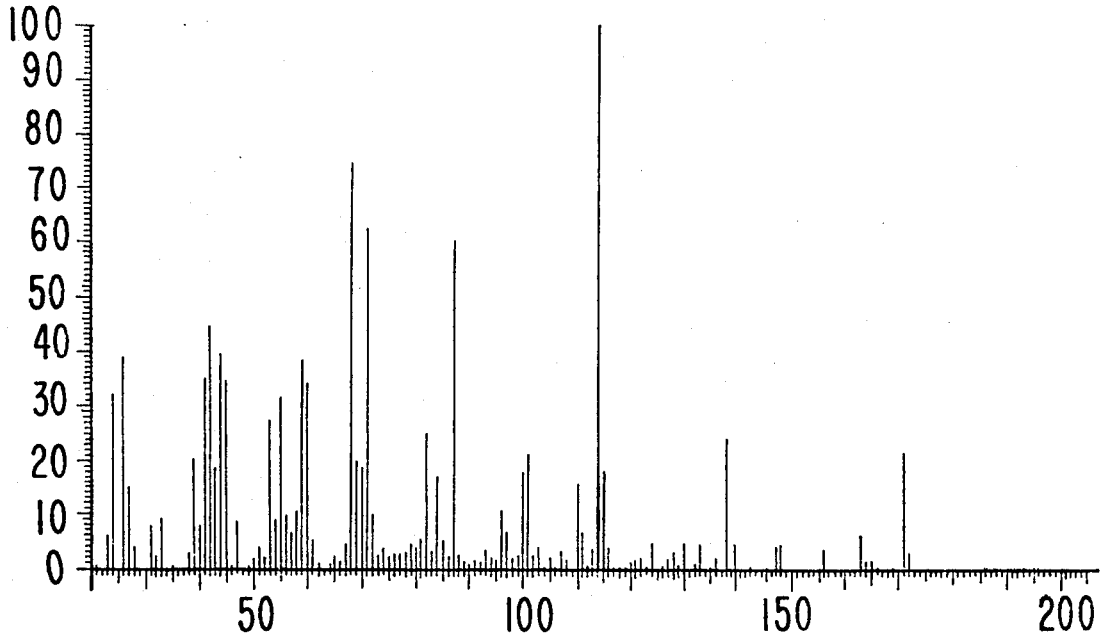
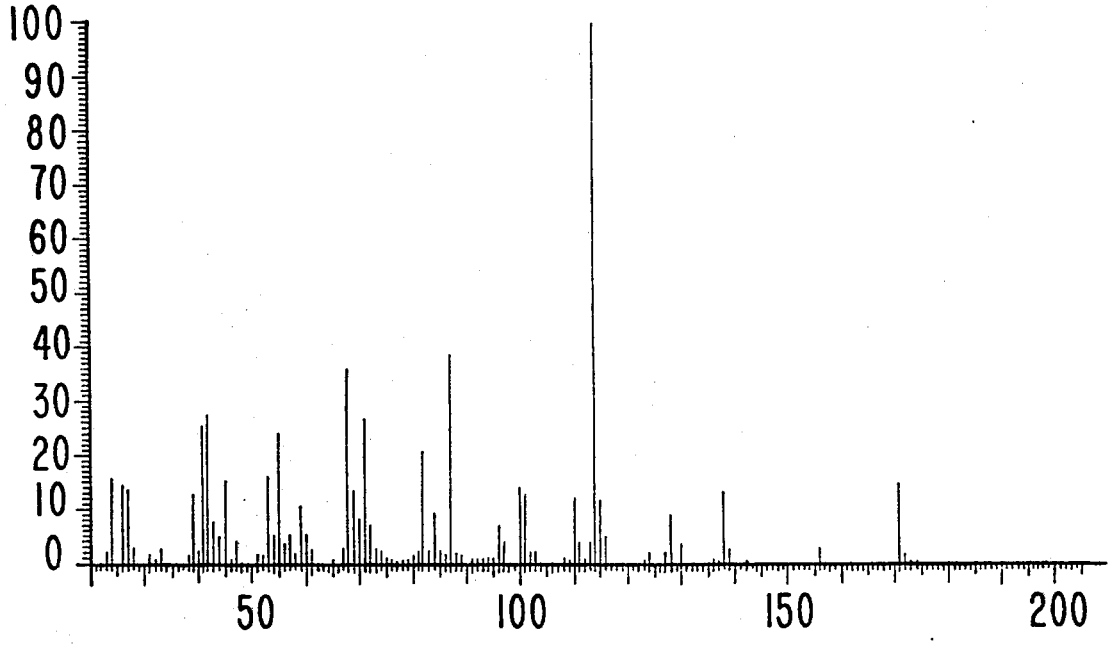
GC-MS PROFILE ISOMER II FOR EXAMPLE II
FIG.5

I R SPECTRUM FOR EXAMPLE II

FIG. 8
GC-MS PROFILE ISOMER I FOR EXAMPLE III
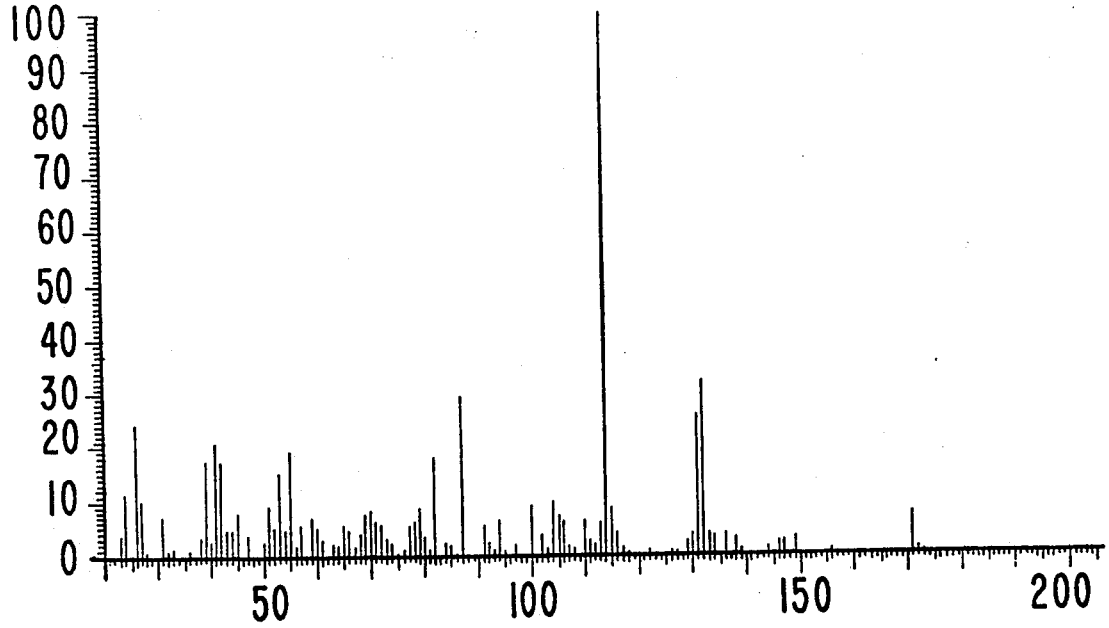
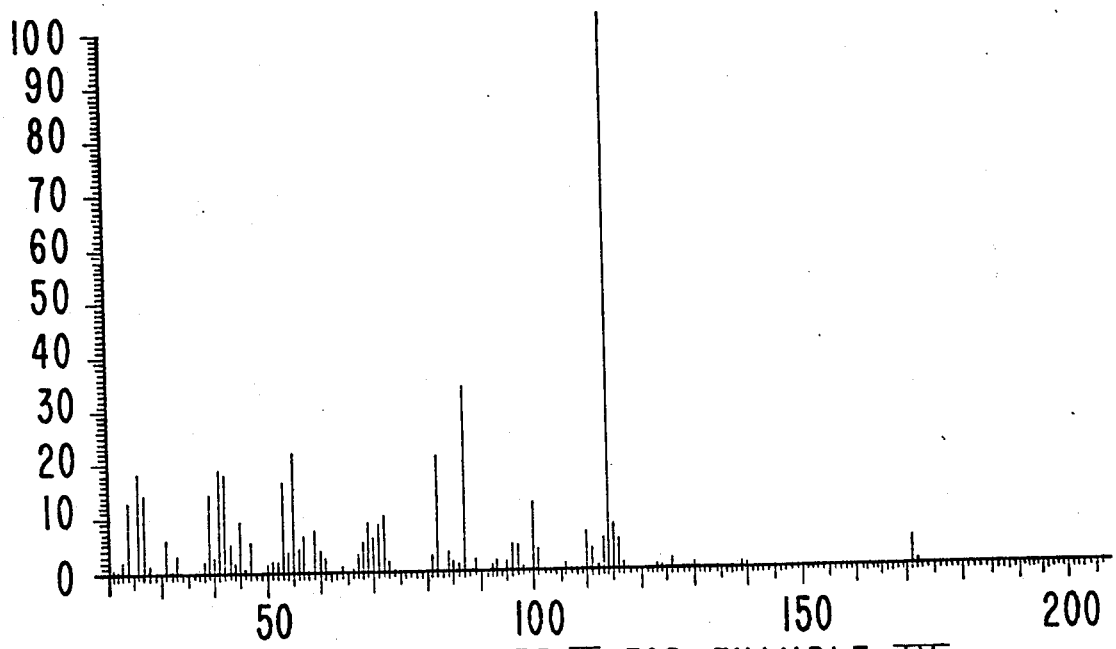
GC-MS PROFILE ISOMER II FOR EXAMPLE III
FIG. 9

I R SPECTRUM FOR EXAMPLE III

NOVEL TOBACCO PRODUCT COMPRISING ONE OR MORE THIAZOLINES AND PROCESS

BACKGROUND OF THE INVENTION

This invention relates to novel tobacco products, novel tobacco flavoring compositions, and processes for producing same, and has for an object the provision of a composition and process for improving the flavor and aroma of tobacco and tobacco smoke.

It is well known in the tobacco art that the flavor and aroma of the tobacco product and smoke from the tobacco are very important considerations insofar as the ultimate consumer is concerned. Considerable efforts have been and are being exerted by the manufacturers of tobacco products to provide a product that will be acceptable to the consumer, particularly as regards flavor and aroma characteristics. It has been the common practice in the tobacco industry to prepare blends of domestic and imported tobaccos in order to provide smoking tobacco which has a pleasing flavor and aroma before and during smoking. However, such a procedure is costly and may at times become prohibitive in the event that certain types of tobacco may be in short supply. Accordingly, there has been considerable work relating to substances which can be used to impart flavors to various tobacco blends. These substances are used to supplement natural materials some of which, as stated above, may be in short supply, and to provide more uniform properties to the finished product.

Nutty, bready, chocolate-like, slightly green, sweet and/or slightly fatty flavor and aroma nuances are particularly desirable for many uses concerning the flavoring of tobacco products; both prior to and on smoking; particularly in "bright" tobaccos.

Due to their general meat-like aromas and flavors, compounds containing the thiazoline nucleus having the structure:

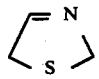

have not been determined to have organoleptic properties causing them to be suitable for use in conjunction with tobacco flavors and aromas. It is thus quite surprising to find that the compounds of the instant invention are suitable for use in conjunction with tobacco flavors and aromas prior to and on smoking.

THE INVENTION

It has now been discovered that tobacco flavoring compositions and tobacco products having sweet, aromatic, nutty, bready, chocolate-like and/or slightly fatty flavor and aroma nuances prior to and on smoking may be provided by adding to tobacco flavors and/or to tobaccos themselves one or more thiazoline compounds having the generic structure:

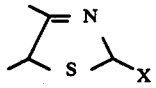

wherein, X is one of:

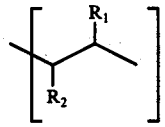

or

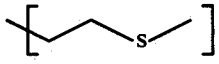

and wherein, one of $R_1$ or $R_2$ is hydrogen and the other of $R_1$ or $R_2$ is methyl.

Specific examples of the compounds contemplated within the scope of our invention, and their tobacco flavor properties prior to and on smoking are as follows:

| COMPOUND NAME | COMPOUND STRUCTURE | ORGANOLEPTIC PROPERTIES PRIOR TO SMOKING | ORGANOLEPTIC PROPERTIES ON SMOKING |
|---|---|---|---|
| 2-(2'-methyl-n-propyl)-4,5-dimethyl-$\Delta^3$-thiazoline | 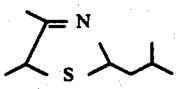 | Chocolate-like, nutty, sweet bready, baked goods aroma and taste. | A sweeter, nutty, bready aroma with slightly green and slight chocolate-like nuances. |
| 2-(2'-butyl)-4,5-dimethyl-$\Delta^3$-thiazoline | 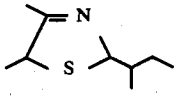 | A sweet, slightly green, nutty, bready aroma and flavor. | Slightly cooling, slightly bready nuances on smoking. |
| 2-(2'-methylthio-ethyl)-4,5-dimethyl-$\Delta^3$-thiazoline | 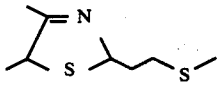 | Burnt aroma with a pleasant slightly fatty nuance. | More aromatic tobacco-like aroma with fatty nuances. |

It has been found that the tobacco additives of our invention when incorporated into tobacco products impart a flavor and aroma both before and during smoking which many smokers consider to be desirable in smoking products. However, it must be pointed out that the methods for defining or characterizing the quality of a flavor or aroma in the tobacco art are almost purely subjective and different smokers may define the same flavor quite differently. Also as indicated in the above table, the compounds included within the scope of this invention may impart different flavors or aromas depending upon the substituents therein. Thus, the compounds comprehended by this invention, by subjective tests, impart characteristic flavors which are desirable in tobacco products and the smoke therefrom even though the exact character thereof cannot be described on the basic of known standards.

In accordance with this invention, one of more of the thiazolines of our invention or mixtures thereof is added to tobacco or applied to a smoking article or its components parts in amounts of about 50–5,000 parts per million (ppm) based on dry weight of the tobacco product. Preferably the amount of additive is between about 100 and 500 ppm by weight in order to provide a tobacco product having a desired flavor and aroma. However, the amount used will depend upon the amount of flavor and aroma desired and the particular thiazoline compound or mixture thereof that is used.

The additive may be incorporated at any step in the treatment of the tobacco, but is preferably added after aging, curing and shredding and before the tobacco is formed into cigarettes. Likewise it will be apparent that only a portion of the tobacco need be treated and the thus-treated tobacco may be blended with other tobaccos before the cigarettes or other smoking articles are formed. In such case the tobacco treated may have the additive in excess of the amounts above indicated so that when blended with other tobaccos, the final product will have the percentage within the indicated range.

In accordance with one specific embodiment of this invention an aged, flue-cured and shredded tobacco is sprayed with a 1% ethyl alcohol solution of a 40:40:20 (weight:weight:weight) mixture of 2-(2′-methyl-n-propyl)-4,5-dimethyl-$\Delta^3$-thiazoline:2-(2′-n-butyl)-4,5-dimethyl-$\Delta^3$-thiazoline:2-(2′-methylthioethyl)-4,5-dimethyl-$\Delta^3$-thiazoline in an amount to provide a tobacco containing 100 ppm by weight of the mixture of thiazoline additives on a dry basis. Thereafter, the alcohol is removed by evaporation, and the tobacco is manufactured into cigarettes by the usual techniques. It has been found that this cigarette, when prepared as indicated, has a desired and pleasing flavor, an aroma to which some people is described as "nutty-bready" and is very much akin to a "bright" tobacco, and is detectable and pleasing in the main and side smoke streams when the cigarette is smoked.

The additives falling within the scope of this invention may be applied to the tobacco by spraying, dipping or otherwise, utilizing suitable suspensions or solutions of the thiazoline additive. Thus, water or volatile organic solvents, such as alcohol, ether, acetone, volatile hydrocarbons and the like, may be used as the carrying medium for the additive while it is being applied to the tobacco. Also, other flavor and aroma producing additives, such as:

a. Esters, for example:
   Ethyl butyrate;
   Ethyl acetate;
   Ethyl valerate;
   Amyl acetate;
   Phenyl ethyl isovalerate; and
   Methyl heptyl carbonate;
b. Aldehydes, for example:
   3-phenyl-2-pentenal;
   3-phenyl-3-pentenal;
   phenyl acetaldehyde;
   Cinnamaldehyde; and
   Beta-ethyl-cinnamaldehyde;
c. Ketones, for example:
   Benzylidene acetone;
   Acetophenone;
   Maltol; and
   Ethyl maltol;
d. Acetals, for example:
   3-phenyl-4-pentenal dimethyl acetal; and
   3-phenyl-4-pentenal diethyl acetal (described in U.S. Pat. No. 3,922,237 issued on Nov. 25, 1975);
e. Natural oils and extracts, for example:
   Vanilla;
   Coffee extract;
   Origanum oil;
   Cocoa extract;
   Oil of cloves;
   Nutmeg oil;
   Celery seed oil;
   Bergamot oil; and
   Ylang-ylang oil;
f. Lactones, for example:
   Delta-decalactone;
   Delta-undecalactone;
   Delta-dodecalactone;
   Gamma-undecalactone; and
   Coumarin;
g. Ethers, for example:
   Dibenzyl ether;
   Vanillin; and
   Eugenol;
h. Pyrazines, for example:
   2-Acetyl pyrazine;
   2-Acetyl-6-methyl pyrazine;
   2-Ethyl pyrazine;
   2,3-Dimethyl pyrazine;
   2,5-Dimethyl pyrazine; and
   2-Ethyl-5-methyl pyrazine;
i. Pyrroles, for example:
   N-cyclopropyl pyrrole; and
   N-cyclooctyl pyrrole;

as well as those additives disclosed in U.S. Pat. Nos. 2,766,145; 2,905,575; 2,905,576; 2,978,365; 3,041,211; 2,766,149; 2,766,150; 3,589,372, 3,288,146, 3,402,051 and 3,380,457 as well as Australian Pat. Nos. 444,545; 444,507 and 444,389 may be incorporated into the tobacco with the additives of this invention.

While this invention is principally useful in the manufacture of cigarette tobacco, it is also suitable for use in connection with the manufacture of pipe tobacco, cigars or other tobacco products. Furthermore, the compounds may be added to certain tobacco substitutes of natural or synthetic origin and by the term "tobacco" as used throughout this specification is meant any composition intended for human consumption by smoking or otherwise, whether composed of tobacco plant parts or substituted materials or both (e.g., dried lettuce leaves and cabbage leaves).

Also, the invention has been particularly described with reference to the addition of the compounds directly to tobacco. However, it will be apparent that the compound may be applied to the paper of the cigarette or to the wrapper of a cigar. Also, it may be incorporated into the filter tip, the packaging material or the seam paste employed for gluing the cigarette paper. Thus, a tobacco product is provided which includes the specified additives and tobacco although in every instance the compound need not be admixed with the tobacco as above specifically described.

The thiazoline derivatives of our invention are obtained by reacting an aldehyde with aqueous ammonia to form the corresponding imine and then subsequently reacting the thus formed imine with 2-mercapto-3-butanone to form the desired thiazoline derivative according to the following reaction sequence:

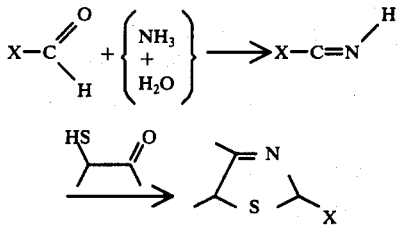

Details concerning the parameters of the abovementioned reaction are exemplified hereinbelow and also are exemplified in the following publications:

German Auslegungschrift No. 1,058,061 published on May 27, 1959

U.S. Pat. No. 2,865,924 issued on Dec. 23, 1958

U.S. Pat. No. 2,879,273 issued on Mar. 24, 1959

German Auslegungschrift 1,068,717 published on Nov. 12, 1959

U.S. Pat. No. 3,700,683 issued on Oct. 24, 1972

German Auslegungschrift No. 1,095,284 published on Dec. 22, 1960

German Auslegungschrift No. 1,063,602 published on Aug. 20, 1959

U.S. Pat. No. 3,931,208 issued on Jan. 6, 1976

U.S. Pat. No. 2,886,571 issued on May 12, 1959.

The following examples are given to illustrate the embodiments of the invention as it is presently preferred to practice it. It will be understood that these examples are illustrative and the invention is not to be considered as restricted thereto except as indicated in the appended claims.

EXAMPLE I

PREPARATION OF 2-(2'-METHYLTHIOETHYL)-4,5-DIMETHYL-$\Delta^3$-THIAZOLINE

Reaction:

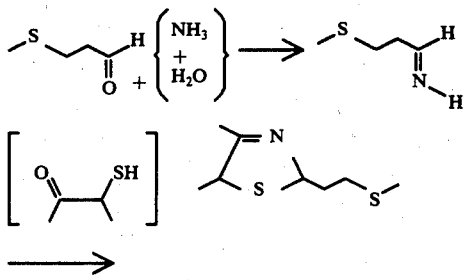

Into a 500 ml, three-necked, round bottom flask, equipped with mechanical stirrer, 250 ml addition funnel, thermometer, Friedrich's condenser and ice-bath is placed 45.2 ml of a 58% aqueous ammonia solution and 45 ml distilled water. Dropwise with stirring, while maintaining the temperature at 25°-28° C, 52 gms of methional is added to the ammonia solution. After the methional is added, dropwise, with stirring over a period of one hour, 104 gms of a 50% solution of 3-mercapto-2-butanone in 95% ethanol is added. The resulting reaction mass is kept at room temperature with stirring during the addition of the 3-mercapto-2-butanone. The reaction mass is then extracted with two 100 ml portions of diethyl ether. The diethyl ether extracts are combined and washed with three 100 ml portions of distilled water and then dried over anhydrous sodium sulfate. The dried extracts are then evaporated on a rotary evaporator and the resulting oil is distilled on a 6 inches Vigreux column at a vapor temperature of 97°-103° C, a liquid temperature of 129°-140° C and a pressure of 2 mm Hg.

The mass spectrum is set forth in FIG. 1. The NMR spectrum is set forth in FIG. 2. The infra-red spectrum is set forth in FIG. 3.

The NMR analysis is as follows:

| Chemical Shift | Assignment | Protons |
|---|---|---|
| 1.50 ppm (doublet of doublets) | $CH_3-\overset{\overset{C=C}{\vert}}{C}-S-$ | 3H |
| 2.08 (d,J=2H$_2$)<br>2.13 (s)<br>2.46-1.86 (m) | $CH_3-C=N-$<br>$CH_3-S-$<br>methylene methine | 8H |
| 2.66 (t) | $-CH_2-S-$ | 2H |
| 4.28 (m) | $\underset{\underset{C=C=}{\vert}}{HC}-S$ | 1H |
| 5.62 (m) | $\underset{\underset{S}{\vert}}{HC}-N=C$ | 1H |

The infra-red analysis is as follows:

880 cm$^{-1}$, 940, 1160, 1120, 1240, 1280, 1370, 1430, 1660, 2920, 2960.

The Mass Spectral analysis is as follows:

| M/E | Relative Intensity |
|---|---|
| 55 | 13 |
| 61 | 19 |
| 68 | 18 |
| 87 | 30[4] |
| 100 | 21[5] |
| 114 | 32[3] |
| 126 | 21[6] |
| 128 | 16 |
| 174 | 100[1] |
| M189 | 44[2] |

EXAMPLE II

PREPARATION OF 2-(2'-METHYL-n-PROPYL)-4,5-DIMETHYL-$\Delta^3$-THIAZOLINE

Reaction:

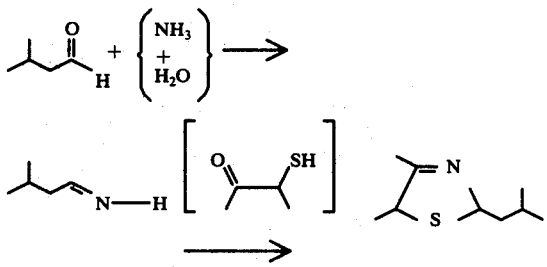

Into a 500 ml, three-necked, round-bottom flask equipped with stirrer, 250 ml addition funnel, ice bath and Friedrich's condenser, is placed 45 ml water and 45 ml 58% aqueous $NH_3$. With stirring, 43 grams of isobutyraldehyde is added dropwise. 104 Grams of a 50% ethanolic solution of 3-mercapto-2-butanone is then added dropwise over a period of one hour. The reaction mass is then allowed to stir for one hour at room temperature.

The resulting product is extracted with three 100 ml portions of diethyl ether. The ether extracts are combined and dried over anhydrous sodium sulfate and then evaporated on a rotary evaporator. The resulting product is then distilled on a 12 inches Vigreux column at 4 mm Hg pressure and 70° C vapor temperature yielding a product containing 97% 2-(2'-methyl-n-propyl)-4.5-dimethyl-$\Delta^3$-thiazoline.

The GLC analysis shows that two isomers exist; an "endo" and an "exo" isomer. The mass spectrum for isomer I is set forth in FIG. 4. The mass spectrum for isomer II is set forth in FIG. 5.

The NMR spectrum for the resulting product is set forth in FIG. 6.

The infrared spectrum for the resulting product is set forth in FIG. 7.

The NMR analysis is as follows:

| Chemical Shift | Assignment | Protons |
|---|---|---|
| 1.00 ppm (doublets of doublets) | "Isopropyl" methyl protons | 6H |
| 1.50 (doublets of doublets) | $CH_3-C(-S-)-C=N-$ | 3H |
| 2.10 (d,J=2H$_2$) | $CH_3-C=N-$ | 3H |
| 2.00–1.60 (m) | $-CH_2- + H-C-$ | 3H |
| 4.25 (m) | $HC(-S)-C=N-$ | 1H |
| 5.55 (m) | $HC-N=C=$ (S–) | 1H |

The IR analysis is as follows:
940 cm$^{-1}$, 1160, 1200, 1370, 1380, 1430, 1440, 1470, 1670, 2880, 2940, 2960.

EXAMPLE III

PREPARATION OF 2-(2'-n-BUTYL)-4,5-DIMETHYL-$\Delta^3$-THIAZOLINE

Reaction:

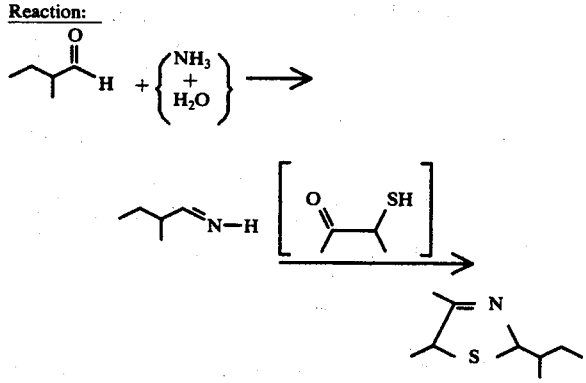

Into a 500 ml, three-necked, round-bottom flask equipped with mechanical stirrer, 250 ml addition funnel, thermometer, Friedrich's condenser, and ice bath, is placed 87.4 ml 30% aqueous ammonia and 45 ml distilled water. 43 Grams 2-methyl butanal is then added dropwise to the reaction mass while maintaining the reaction mass at room temperature. After completion of the addition of the 2-methyl butanal, 104 grams of a 50% (in 95% ethanol) solution of 3-mercapto-2-butanone is added dropwise over a period of one hour. The reaction mass is then extracted with 300 ml diethyl ether in 3 portions. The ether extracts are combined and dried over anhydrous sodium sulfate, and then evaporated on a rotary evaporator. The resulting product is then distilled at a vapor temperature of 105°–107° C and a vacuum of 20 mm Hg yielding a product containing 98% 2-(2'-butyl)-4,5-dimethyl-$\Delta^3$-thiazoline. The distillation is carried out on a 12 inches Vigreux column. In order to purify the resulting product, it is redistilled at 60°–61° C at a pressure of 3 mm Hg.

The resulting material exists in two isomeric forms, an "endo" and an "exo" form. The mass spectrum for the first isomer is set forth in FIG. 8. The mass spectrum for the second isomer is set forth in FIG. 9.

The NMR spectrum is set forth in FIG. 10.

The infrared spectrum for the resulting material is set forth in FIG. 11.

The NMR analysis is as follows:

| Chemical Shift | Assignment | Protons |
|---|---|---|
| 1.01–0.80 ppm | methyl proton | 6H |
| 1.46 | $CH_3-C(-S-)-C=N-$ | 3H |
| 2.08 | $CH_3-C=N-$ | 3H |
| 1.94–1.18 | methylene methine protons | 3H |
| 4.20 | $H-C(-C=C)-S-$ | 1H |
| 5.54 | $H-C(-S-)-N=C-$ | 1H |

The IR analysis is as follows:
910 cm$^{-1}$, 1250, 1370, 1430, 1450, 1460, 1670, 2880, 2940, 2960.

| M/E | Relative Intensity |
|---|---|
| 41 | 9 |
| 42 | 8 |
| 55 | 8 |
| 71 | 7 |
| 82 | 14$^4$ |
| 87 | 22$^2$ |
| 100 | 9$^5$ |
| 114 | 100$^1$ |
| 115 | 9$^6$ |
| M 171 | 17$^3$ |

EXAMPLE IV

TOBACCO USE OF 2-(2'-METHYLTHIOETHYL)-4,5-DIMETHYL-$\Delta^3$-THIAZOLINE

The following tobacco Formulation (A) is prepared:

| Ingredients | Parts |
|---|---|
| Ethyl Butyrate | 0.05 |
| Ethyl Valerate | 0.05 |

-continued

| Ingredients | Parts |
|---|---|
| Maltol | 2.00 |
| Cocoa Extract | 26.00 |
| Coffee Extract | 10.00 |
| Ethanol (95% aqueous) | 20.00 |
| Water | 41.90 |

The following tobacco Formulation (B) is prepared:

| Ingredients | Parts |
|---|---|
| Bright Tobacco | 40.1 |
| Burley Tobacco | 24.9 |
| Maryland Tobacco | 1.1 |
| Turkish Tobacco | 11.6 |
| Stem (Flue-cured) Tobacco | 14.2 |
| Glycerine | 2.8 |
| Water | 5.3 |

The flavor Formulation (A) is added to a portion of the smoking tobacco Formulation (B) at the rate of 0.1% by weight of the tobacco. The flavored and non-flavored tobacco formulations are then formulated into cigarettes by the usual manufacturing procedure:

At the rate of 100 ppm to half of the cigarettes in each group is added 2-(2'-methylthioethyl)-4,5-dimethyl-$\Delta^3$-thiazoline. The use of the 2-(2'-methylthioethyl)-4,5-dimethyl-$\Delta^3$-thiazoline in the cigarettes causes the cigarettes, prior to smoking to have a burnt aroma, with a pleasant slightly fatty nuance. In smoke flavor, these notes are still found and the tobacco flavor on smoking is more aromatic and renders the tobacco more "bright" -like whether or not the other flavor ingredients of Formulation (A) are present.

EXAMPLE V

TOBACCO USE OF 2-(2'-METHYL-n-PROPYL)-4,5-DIMETHYL-$\Delta^3$-THIAZOLINE

The following tobacco flavor Formulation (A) is prepared:

| Ingredients | Parts |
|---|---|
| Ethyl Butyrate | 0.05 |
| Ethyl Valerate | 0.05 |
| Maltol | 2.00 |
| Cocoa Extract | 26.00 |
| Coffee Extract | 10.00 |
| Ethanol (95% Aqueous) | 20.00 |
| Water | 41.90 |

The following tobacco Formulation (B) is prepared:

| Ingredients | Parts |
|---|---|
| Bright Tobacco | 40.1 |
| Burley Tobacco | 24.9 |
| Maryland Tobacco | 1.1 |
| Turkish Tobacco | 11.6 |
| Stem (Flue-cured) Tobacco | 14.2 |
| Glycerine | 2.8 |
| Water | 5.3 |

The flavor Formulation (A) is added to a portion of the smoking tobacco Formulation (B) at the rate of 0.1% by weight of the tobacco. The flavored and non-flavored tobacco formulations are then formulated into cigarettes by the usual manufacturing procedure:

At the rate of 100 ppm to half of the cigarettes in each group is added 2-(2'-methyl-n-propyl)-4,5-dimethyl-$\Delta^3$-thiazoline. The use of the 2-(2'-methyl-n-propyl)-4,5-dimethyl-$\Delta^3$-thiazoline in the cigarettes causes the cigarettes, prior to smoking to have a chocolate-like, nutty, sweet, bready, baked goods aroma and taste. In smoke flavor, these notes are still found and the tobacco flavor on smoking has a sweeter, nutty, bready aroma with slight green and slight chocolate-like nuances causing it to be very closely akin to "bright" tobacco whether or not other flavor ingredients of Formulation (A) are present.

EXAMPLE VI

TOBACCO USE OF 2-(2'-n-BUTYL)-4,5-DIMETHYL-$\Delta^3$- THIAZOLINE

The following tobacco flavor Formulation (A) is prepared:

| Ingredients | Parts |
|---|---|
| Ethyl Butyrate | 0.05 |
| Ethyl Valerate | 0.05 |
| Maltol | 2.00 |
| Cocoa Extract | 26.00 |
| Coffee Extract | 10.00 |
| Ethanol (95% aqueous) | 20.00 |
| Water | 41.90 |

The following tobacco Formulation (B) is prepared:

| Ingredients | Parts |
|---|---|
| Bright Tobacco | 40.1 |
| Burley Tobacco | 24.0 |
| Maryland Tobacco | 1.1 |
| Turkish Tobacco | 11.6 |
| Stem (Flue-cured) Tobacco | 14.2 |
| Glycerine | 2.8 |
| Water | 5.3 |

The flavor Formulation (A) is added to a portion of the smoking tobacco Formulation (B) at the rate of 0.1% by weight of the tobacco. The flavored and non-flavored tobacco formulations are then formulated into cigarettes by the usual manufacturing procedure:

At the rate of 100 ppm to half of the cigarettes in each group is added 2-(2'-n-butyl)-4,5-dimethyl-$\Delta^3$-thiazoline. The use of the 2-(2'-n-butyl)-4,5-dimethyl-$\Delta^3$-thiazoline in the cigarettes causes the cigarettes, prior to smoking to have a sweet, slightly green, nutty, bready aroma and flavor. In smoke flavor, these notes are still found and the tobacco flavor on smoking has a noticeable cooling characteristic with slightly bready nuances causing it to be very closely akin to "bright" tobacco, whether or not other flavor ingredients of Formulation (A) are present.

EXAMPLE VII

TOBACCO FLAVOR FORMULATION

A tobacco flavoring formulation is prepared by admixing the following ingredients:

| Ingredients | Parts |
|---|---|
| Bergamot Oil, Italy | 5.00 |
| Ylang-ylang oil | 1.20 |
| 2-(2'-methyl-n-propyl)-4,5-dimethyl-$\Delta^3$-thiazoline | 1.40 |
| Acetophenone | 1.20 |
| Phenyl acetaldehyde | 0.50 |
| Phenyl ethyl isovalerate | 1.00 |
| Methyl heptyl carbonate | 0.50 |
| 3-Phenyl-4-pentenal diethyl acetal prepared according to the process disclosed in U.S. Pat. No. 3,922,237 issued on November 25, 1975 | 20.00 |

-continued

| Ingredients | Parts |
|---|---|
| 95% Aqueous Ethanol | 69.40 |

The foregoing flavor is added to smoking tobacco at the rates of 0.10%, 0.20% and 0.30% based on the weight of dry tobacco. The tobacco is then manufactured into cigarettes according to standard manufacturing practice. The purpose of the 3-phenyl-4-pentenal diethyl acetal is to cause the tobacco on smoking to have a hay, clover-like flavor with fruity notes. The 2-(2'-methyl-n-propyl)-4,5-dimethyl-$\Delta^3$-thiazoline (at concentrations, based on the dry weight of tobacco, of 200 ppm) acts as an excellent additive to supply a strong, intense, long-lasting "bright" note to this previously blended tobacco flavor formulation. This is due to the bready, nutty taste nuances imparted by said thiazoline derivative.

BRIEF DESCRIPTION OF THE DRAWINGS

FIG. 2 represents the NMR spectrum for 2-(2'-methylthioethyl)-4,5-dimethyl-$\Delta^3$-thiazoline produced according to Example I.

FIG. 3 represents the Infra-red spectrum for 2-(2'-methylthioethyl)-4,5-dimethyl-$\Delta^3$-thiazoline produced according to Example I.

FIG. 4 represents the Mass spectrum for the first isomer of 2-(2'-methyl-n-propyl)-4,5-dimethyl-$\Delta^3$-thiazoline produced according to Example II.

FIG. 5 represents the Mass spectrum of the second isomer of 2-(2'-methyl-n-propyl)-4,5-dimethyl-$\Delta^3$-thiazoline produced according to Example III.

FIG. 8 represents the Mass spectrum for the first isomer of 2-(2'-n-butyl)-4,5-dimethyl-$\Delta^3$-thiazoline produced according to Example III.

FIG. 9 represents the Mass spectrum for the second isomer of 2-(2'-n-butyl)-4,5-dimethyl-$\Delta^3$-thiazoline produced according to Example III.

Figure 1:
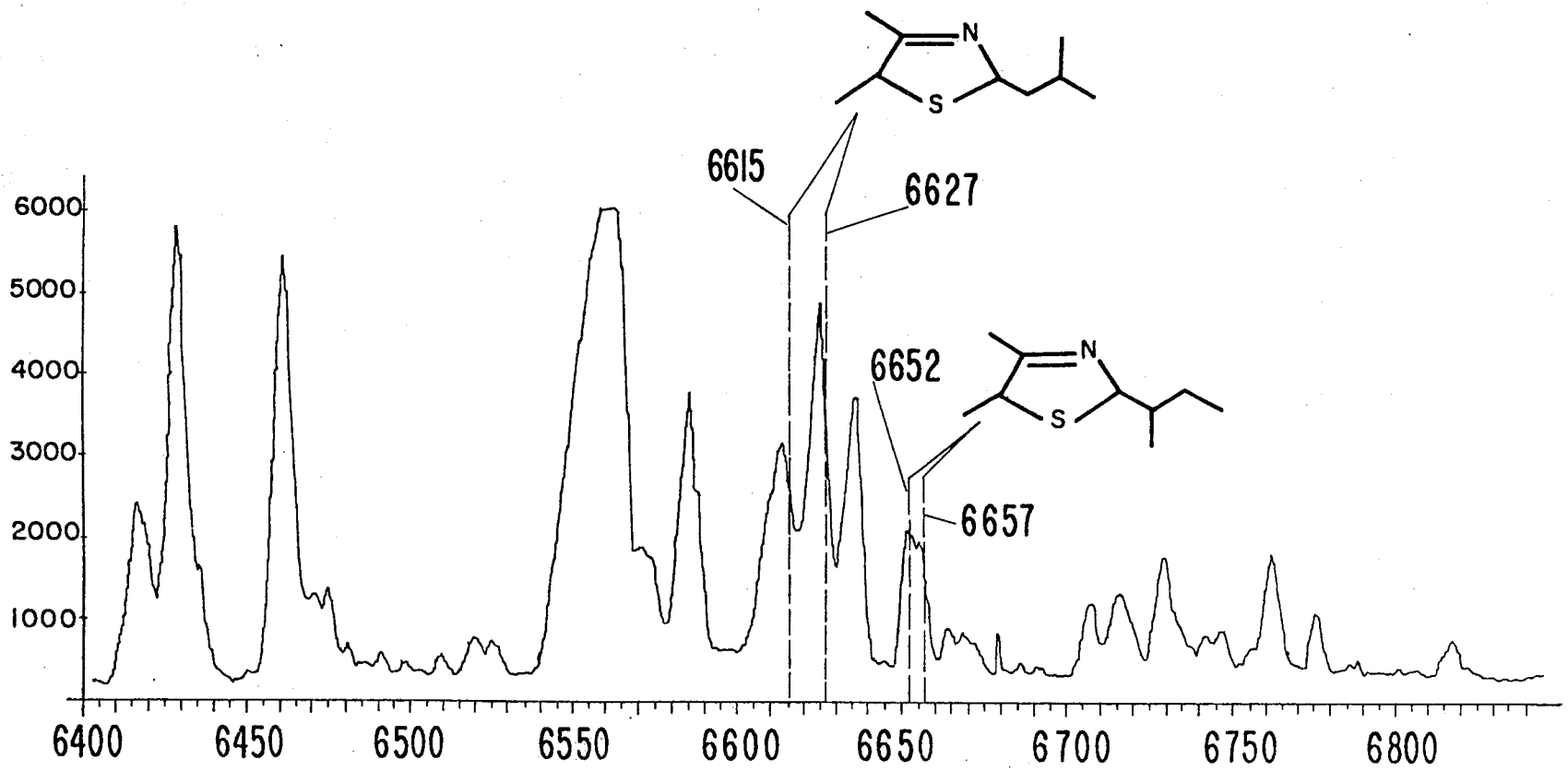
FIG. 1 represents the Mass spectrum for 2-(2'-methylthioethyl)-4,5-dimethyl-$\Delta^3$-thiazoline produced according to Example I.
Figure 6:
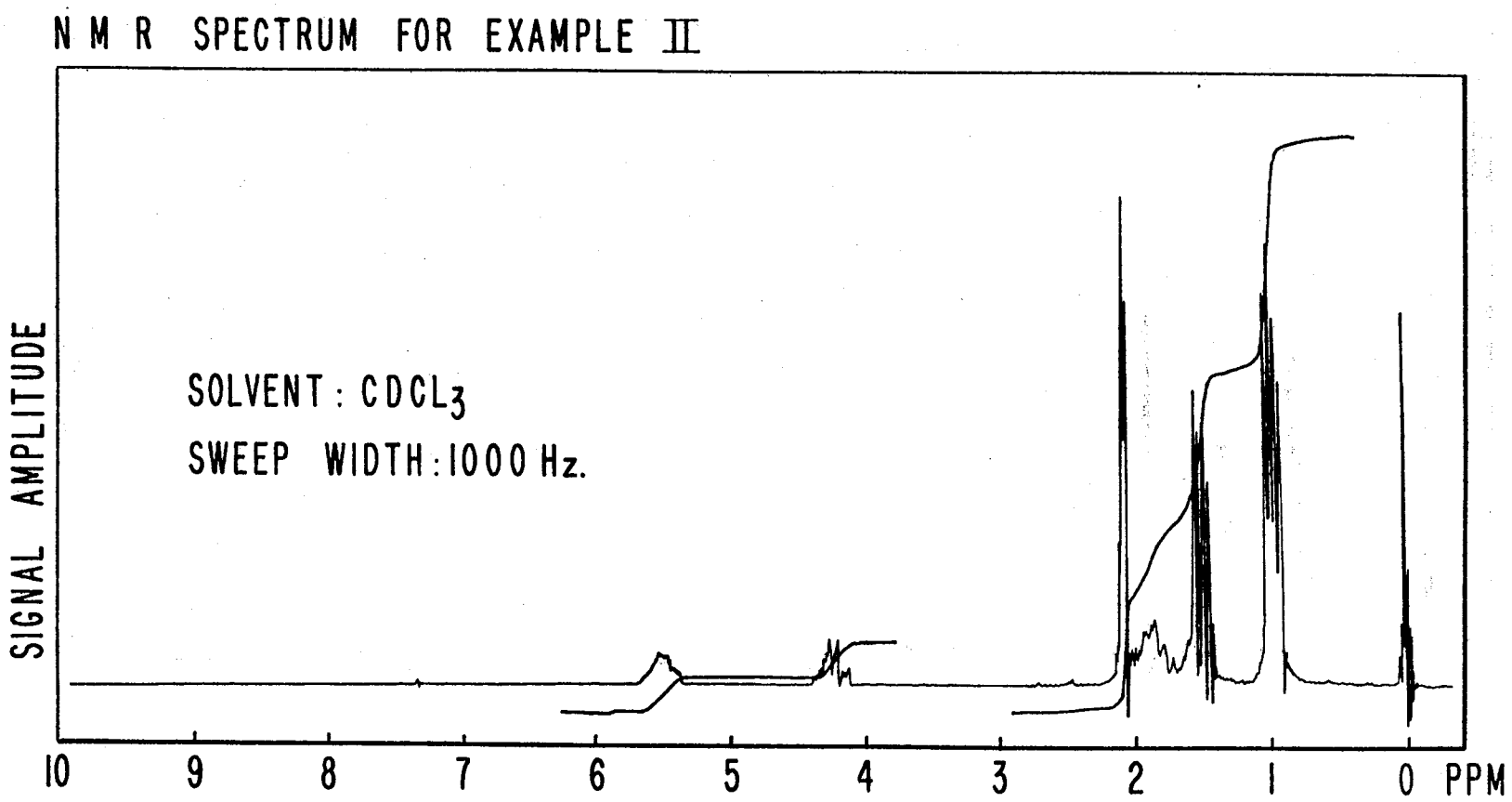
FIG. 6 represents the NMR spectrum for 2-(2'-methyl-n-propyl)-4,5-dimethyl-$\Delta^3$-thiazoline produced according to Example II.
Figure 7:
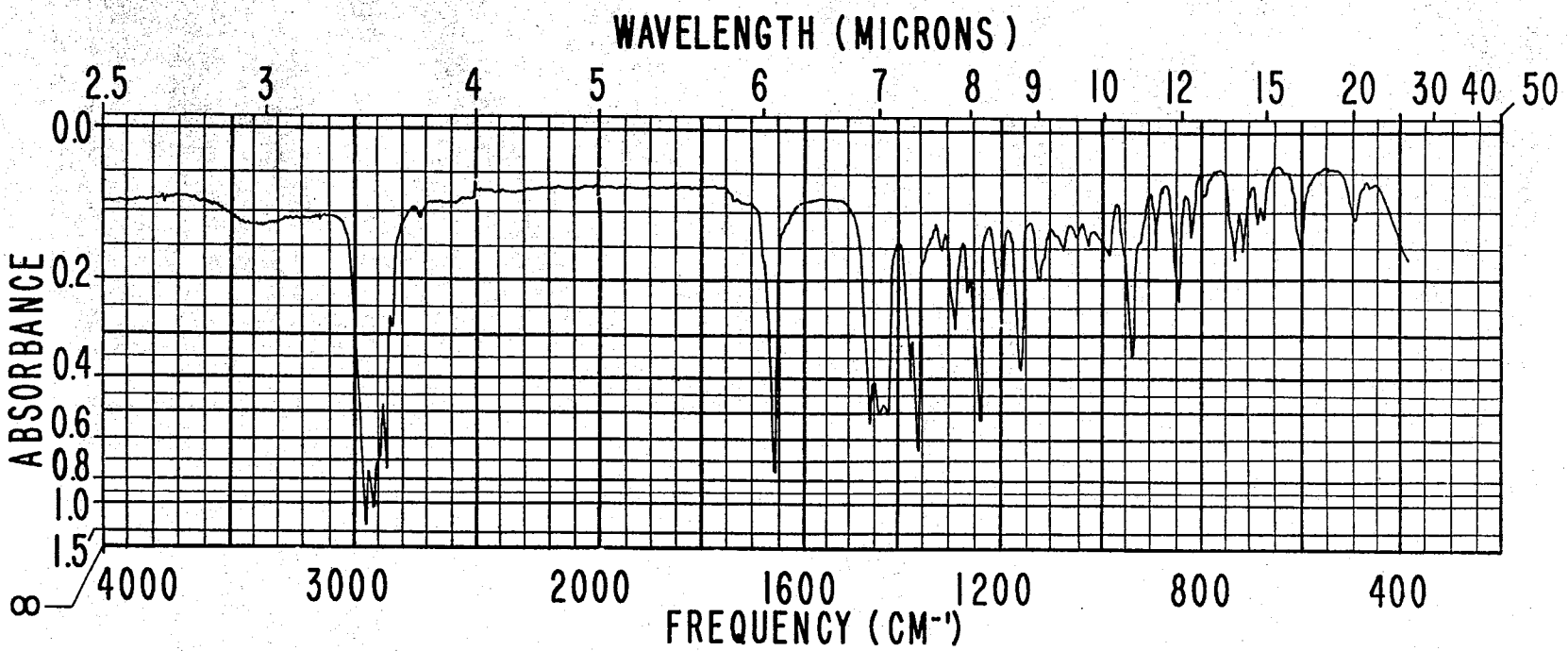
FIG. 7 represents the Infra-red spectrum for 2-(2'-methyl-n-propyl)-4,5-dimethyl-$\Delta^3$-thiazoline produced according to Example II.
Figure 10:
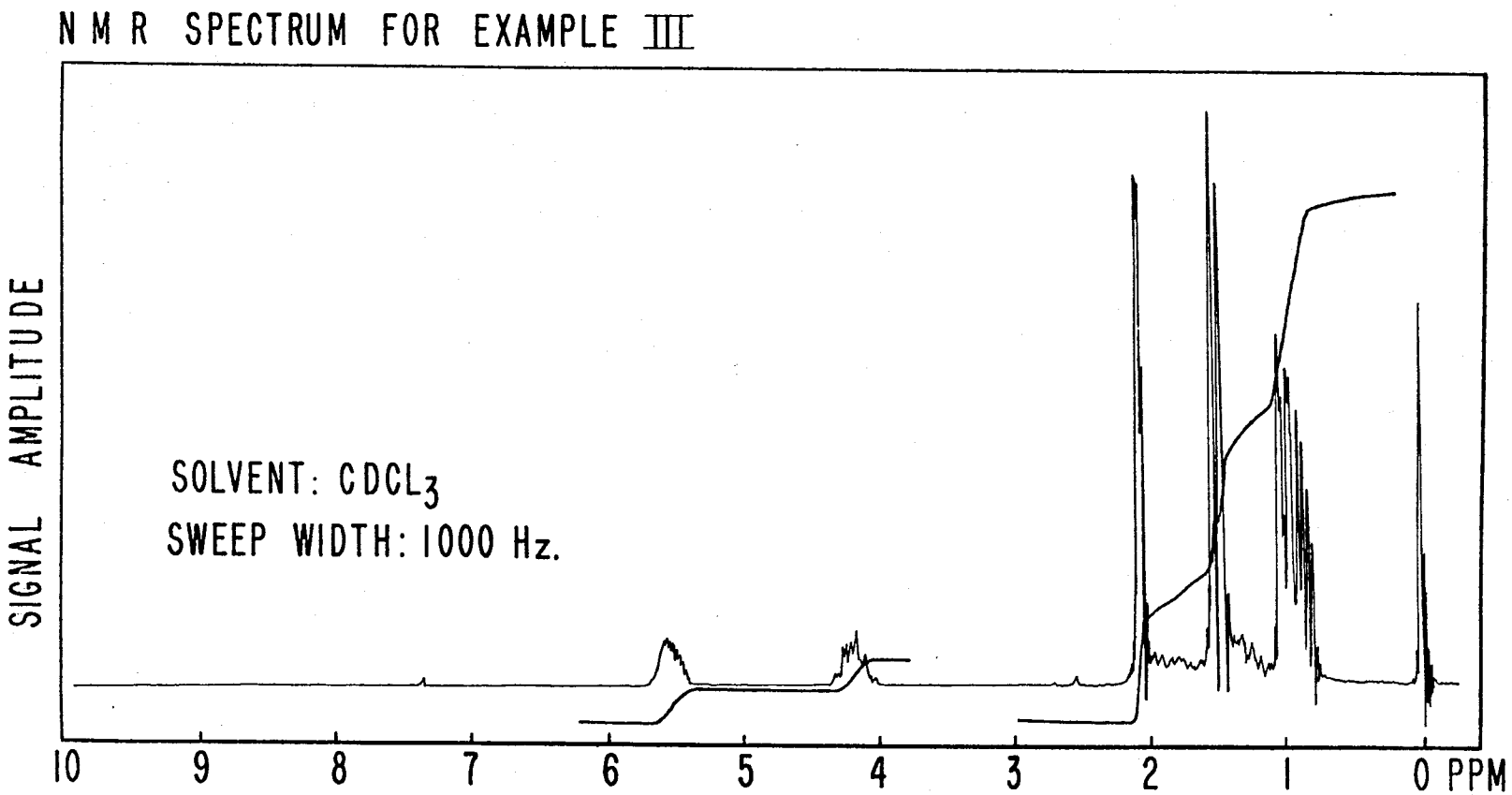
FIG. 10 represents the NMR spectrum for 2-(2'-n-butyl)-4,5-dimethyl-$\Delta^3$-thiazoline produced according to Example III.
Figure 11:
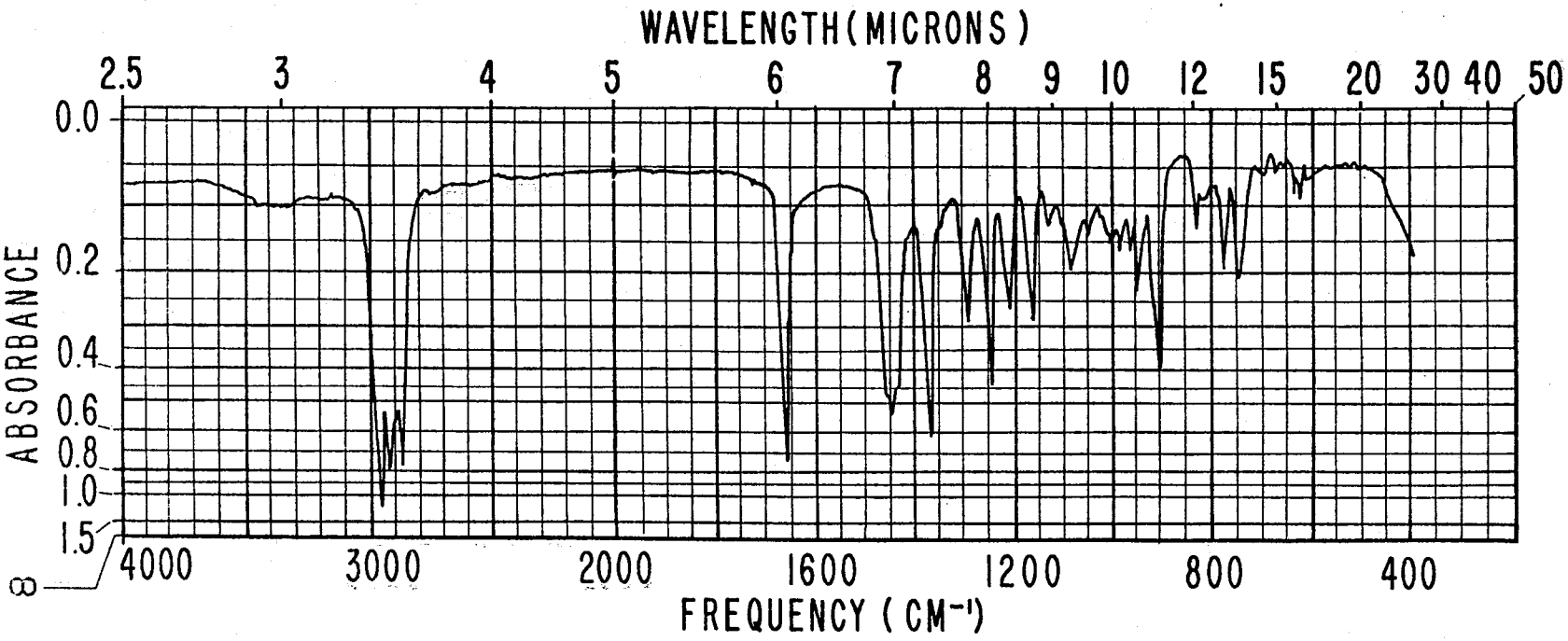
FIG. 11 represents the Infra-red spectrum for 2-(2'-n-butyl)-4,5-dimethyl-$\Delta^3$-thiazoline produced according to Example III.

What is claimed is:

1. A smoking tobacco product comprising smoking tobacco and having added thereto and intimately admixed therewith an amount sufficient to augment or enhance the flavor or aroma of said smoking tobacco product, of one or more thiazoline compounds having the formula:

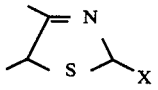

wherein X is selected from the group consisting of:

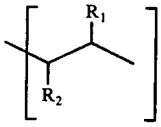

or

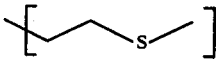

and wherein $R_1$ and $R_2$ are selected from the group consisting of hydrogen and methyl, $R_1$ and $R_2$ being different.

2. The smoking tobacco product of claim 1 wherein, in the thiazoline derivative, X is:

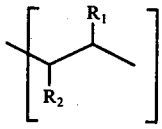

and $R_1$ is methyl and $R_2$ is hydrogen.

3. The smoking tobacco product of claim 1 wherein, in the thiazoline derivative, X is:

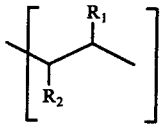

and $R_1$ is hydrogen and $R_2$ is methyl.

4. The smoking tobacco product of claim 1 wherein, in the thiazoline derivative, X is:

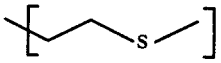

5. The smoking tobacco product of claim 1 wherein the concentration of thiazoline in the smoking tobacco product is from 50 up to 5,000 parts per million (ppm) based on the total weight of tobacco on a dry basis.

6. The smoking tobacco product of claim 1 wherein the concentration of thiazoline in the smoking tobacco product is from 100 up to 500 parts per million (ppm) based on the total weight of tobacco on a dry basis.

7. A smoking tobacco flavoring composition comprising (i) one or more thiazoline compounds having the structure:

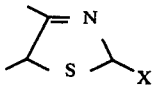

wherein X is selected from the group consisting of:

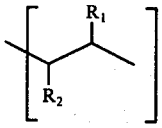

-continued or

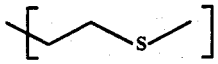

and $R_1$ and $R_2$ are each different and are selected from the group consisting of hydrogen and methyl; the remainder of said composition being (ii) at least one tobacco flavoring additive selected from the group consisting of:

Ethyl butyrate;

Ethyl valerate;

Maltol;

Cocoa extract; and

Coffee extract.

8. The smoking tobacco flavoring composition of claim 7 wherein, in the thiazoline derivative, X is:

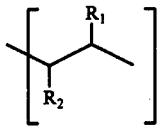

and $R_1$ is methyl and $R_2$ is hydrogen.

9. The smoking tobacco flavoring composition of claim 7 wherein, in the thiazoline derivative, X is:

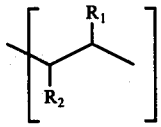

and $R_2$ is methyl and $R_1$ is hydrogen.

10. The smoking tobacco flavoring composition of claim 7 wherein, in the thiazoline derivative, X is:

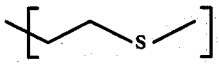

* * * * *